United States Patent [19]

Buehler et al.

[11] Patent Number: 4,742,188

[45] Date of Patent: May 3, 1988

[54] SLIDING ELECTRICAL CONTROL

[75] Inventors: David L. Buehler, Bethlehem; Michael J. Rowen, Emmaus, both of Pa.

[73] Assignee: Lutron Electronics Co., Inc., Coopersburg, Pa.

[21] Appl. No.: 29,688

[22] Filed: Mar. 24, 1987

[51] Int. Cl.[4] ..... H01H 15/00; H01R 9/00

[52] U.S. Cl. ..... 200/16 R; 338/198

[58] Field of Search ..... 200/5 E, 160, 16 C, 200/16 D, 16 R; 338/176, 179, 198, 200, 215, 199

[56] References Cited

U.S. PATENT DOCUMENTS

| | | | |
|---|---|---|---|
| 3,746,923 | 7/1973 | Spira et al. | 315/291 |
| 4,104,606 | 8/1978 | DeWitt | 338/198 |
| 4,186,288 | 1/1980 | Overton et al. | 200/164 R |
| 4,210,791 | 7/1980 | Sorenson | 200/164 R |
| 4,316,067 | 2/1982 | Whiteman, Jr. | 200/291 |
| 4,543,454 | 9/1985 | Cobb, III et al. | 200/16 A |
| 4,689,547 | 8/1987 | Rowen et al. | 200/160 X |

OTHER PUBLICATIONS

ALPS Potentiometer Catalog, 1986, p. 9.

*Primary Examiner*—J. R. Scott

*Attorney, Agent, or Firm*—James Riesenfeld

[57] ABSTRACT

A sliding electrical control provides a method for controlling the power to electrical systems, such as lamps, motors, etc. from more than one location. The control is designed to be mounted on one side of a plate and operated from the other side. It thus permits a slide for operating the control to be mounted closer to a wall than was possible before. In a preferred embodiment, the control includes a biasing spring, which reduces any tendency to rock, rather than slide, when the motion of the slide is begun.

8 Claims, 2 Drawing Sheets

SLIDING ELECTRICAL CONTROL

BACKGROUND OF THE INVENTION

1. Field of the Invention

This invention relates to an electrical control and, more particularly, to a sliding control that mounts on one side of a plate and is operated from the other side.

2. Description of the Prior Act

Sliding controls—generally, either linear or rotary in operation—provide a convenient method for controlling electrical devices, such as lighting systems. In situations where it is desirable to control a single device from multiple locations, slide controls may be located at several locations, each slide control including a "take-command" switch. Each switch serves to exclusively activate its associated slide control; thus, when a slide is moved, its switch operates to pass control of the electrical device to that slide control. Circuitry for controlling an electrical load dimming system from multiple locations is disclosed in co-assigned U.S. patent application Ser. No. 857,739, filed Apr. 29, 1986, now U.S. Pat. No. 4,689,547, issued Aug. 25, 1987, to M. Rowen et al. That application also discloses embodiments for the mechanical structure of the take-command switch, in which the take-command switch is activated directly by the slide.

As between linear and rotary controls, linear slide controls are generally preferred. They are easy to use and, in contrast with rotary controls, they show directly the control setting as a fraction of the full travel of the control.

Slide potentiometers are known in which a sliding electrical conductor is in the form of one or more resilient wires bent into a form and encased within a housing so that the sliding wires are urged against a stationary conductor at one or more points in a line. An example of such a potentiometer is Model RS30111 Slide Potentiometer, sold by Alps Electric, Rockville Center, NY.

SUMMARY OF THE INVENTION

In accordance with the present invention, a sliding electrical control comprises:

(a) a mounting plate having a first and second surface and an elongated slot through it;

(b) a stationary electrical conductor spaced apart from and supported by the mounting plate first surface;

(c) a slidable electrical conductor mounted for sliding parallel to the elongated slot, while maintaining electrical contact with the stationary electrical conductor;

(d) a switch between the mounting plate first surface and the slidable electrical conductor, coupled to the slidable electrical conductor and having two opposite ends that secure switch actuators facing in opposite directions, parallel to the elongated slot;

(e) a cap comprising (i) a top section between the mounting plate first surface and the switch, for sliding along the mounting plate first surface and (ii) an end section adjoining each of the actuators for transmitting forces to operate the actuators adn to slide the switch; and (f) coupling means for transmitting a force through the slot to the cap.

DETAILED DESCRIPTION OF THE INVENTION

The present invention provides an improved linear slide control for electrical devices. The improvement comprises a mechanical design for the control that provides efficient transfer of a force to both a switch and a slidable electrical conductor, such as a potentiometer. The control is particularly useful for systems in which a single electrical device is to be controlled from multiple locations. In those systems, the switch on the linear slide control is a take-command switch, which provides to its associated slide exclusive control of the electrical device.

Figure 1:
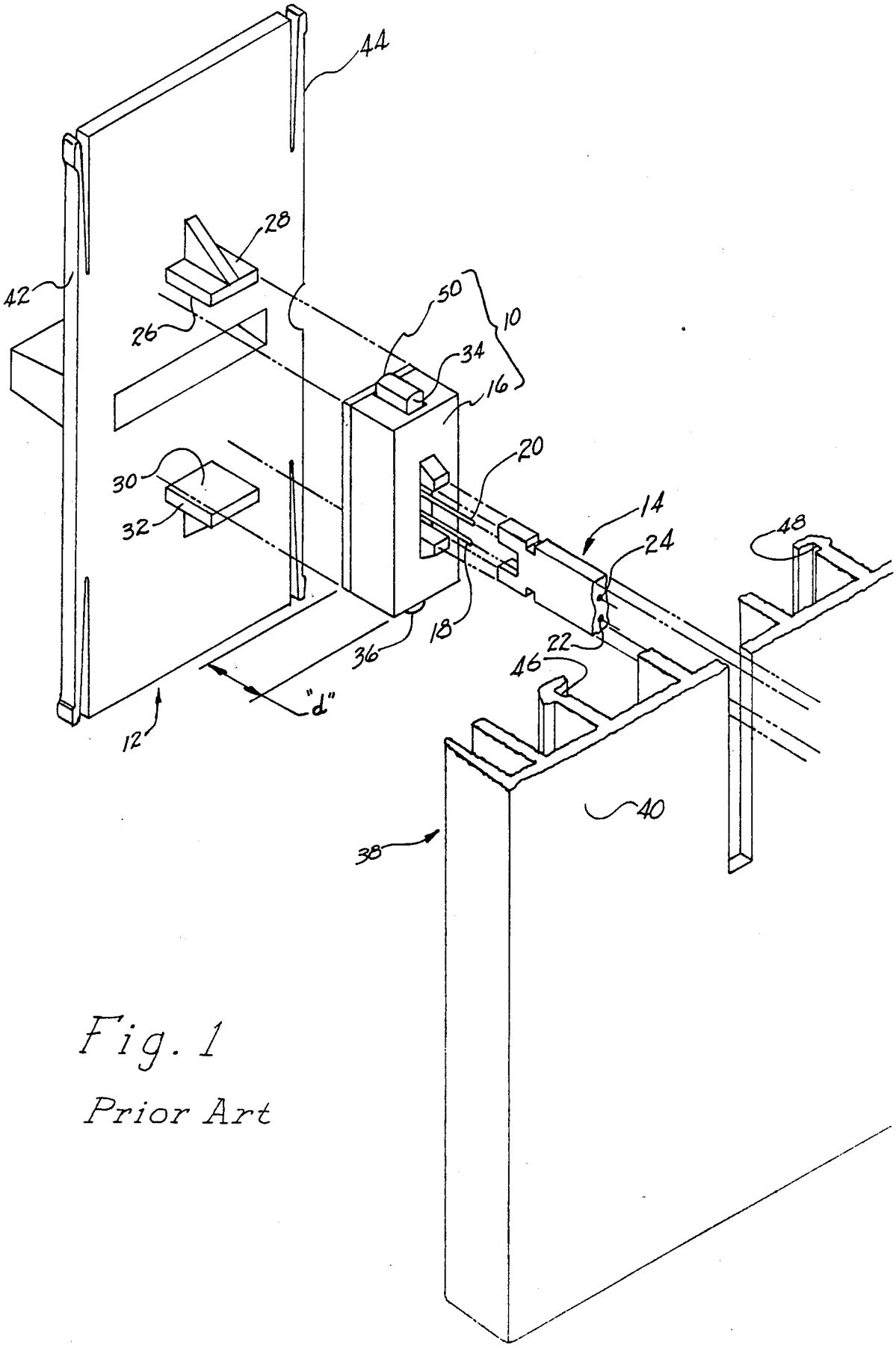
Fig. 1 Prior Art
FIG. 1 is an exploded view of a sliding electrical control of the prior art.

FIG. 1 shows an element of a prior art multiple location control system. The element incorporates pushbutton switch 10, which cooperates with slider 12 and potentiometer actuator 14. Cradle 16 of switch 10 fits over the end of potentiometer actuator 14. Connector pins 18 and 20 make connection with contacts (not shown) inside potentiometer actuator shaft 14. Wires 22 and 24 are connected to these contacts and hence to connector pins 18 and 20, respectively, so as to connect switch 10 to associated circuitry through movable connections inside the potentiometer (not shown). Alternatively, switch 10 can be connected to associated circuitry with a flexible printed circuit board outside the actuator shaft.

Dimmer slide 12 fits over switch 10, with surface 26 of standoff 28 and surface 30 of standoff 32 clearing buttons 34 and 36 respectively. Dimmer slider 12 may be supported and guided in heat sink 38, generally as shown in U.S. Pat. No. 3,746,923, incorporated herein by reference. In a typical application, surface 40 mounts on a wallbox, and the dimension "d" of switch 10 limits how close to the wall slider 12 may be mounted.

In operation, slider edges 42 and 44 slide in heat sink slots 46 and 48, respectively. Moving dimmer slider 12 in a downwards direction (as viewed in FIG. 1) causes surface 26 of standoff 28 to first contact extended base 50 of button 34 and then to depress button 34 to close switch 10. Further motion of dimmer slider 12 in a downward direction will cause potentiometer actuator 14 to move in a downward direction, changing the potentiometer setting.

Releasing dimmer slider 12 stops downward movement of potentiometer actuator 14, and allows button 34 to return to its rest position against cradle 16 where it is held by a spring (not shown). Similarly, upward motion of dimmer slider 12 causes button 36 to move upward, once again closing switch 10, before transferring the motion of dimmer slider 12 to potentiometer actuator 14.

In contrast with the take-command switch disclosed in application Ser. No. 857,739 (now U.S. Pat. No. 4,689,547), depicted in FIG. 1, the take-command switch of the present invention is on the opposite side of the heat sink from the slider; thus, the slider may be mounted closer to the wall.

Figure 2:
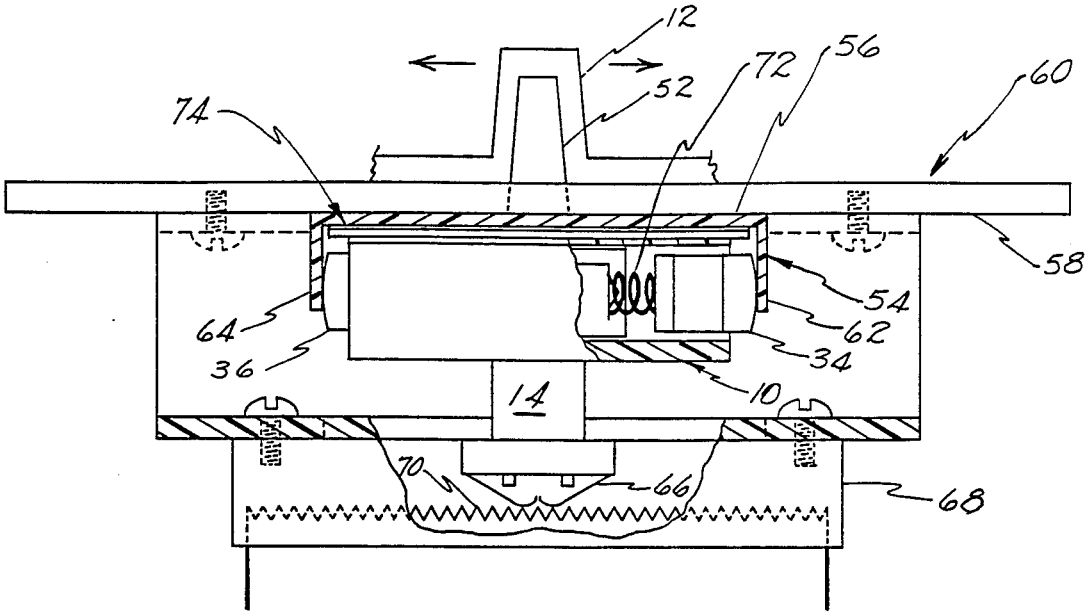
FIG. 2 is a side view in partial cutaway of an electrical control of the present invention.

FIG. 2 is a cutaway view of an electrical control of the present invention. Note that elements which appear in more than one figure have the same reference number in each. Optional slider 12 fits into coupling arm 52. Coupling arm 52 may be an independent element or, alternatively, it may be a part of cap 54 or slider 12. As slider 12 is moved left or right (as viewed in FIG. 2), the top section 56 of cap 54 slides along the bottom surface 58 of mounting plate 60. End sections 62 and 64 of cap 54 clear buttons 34 and 36, respectively, of switch 10. Moving slider 12 to the left first causes end section 62 to depress push button 34, closing switch 10 (which is normally open). Moving slider 12 further to the left causes switch 10 to move to the left and, with it, shaft 14. Shaft 14 is connected to electrical conductor 66, which slides within housign 68, while maintaining contact with a second, stationary electrical conductor 70. The electrical conductors preferably compose a potentiometer. The term "electrical conductor", as used in this specification and the appended claims, is intended to refer to materials that can carry an electrical current. Typically, one of the conductors is a resistive element, having substantially higher resistance than the other conductor. The resistive element may be either the sliding or the stationary conductor. When the force moving slider 12 to the left is released, push button 34 returns to the "rest" position shown in FIG. 2, forced out by spring 72 in switch 10, opening the switch. Similarly, when slider 12 is moved right, pushbutton 36 is depressed and switch 10 is closed; continuing to move the slider right moves shaft 14 right. When the force moving the slider is released, a spring returns push button 36 to the rest position, opening switch 10.

The fact that the slider of the present control does not directly contact the take-control switch (as in the prior art control) necessitates the use of an additional element—cap 54. The cap may "rock," i.e., rotate slightly, rather than slide along surface 58 when it is first moved. The tendency to rock can be reduced by tightening dimensional tolerances; however, optional spring 74 provides an alternative solution. Spring 74 pushes top section 56 of cap 54 against surface 58, greatly reducing rocking.

Figure 3:
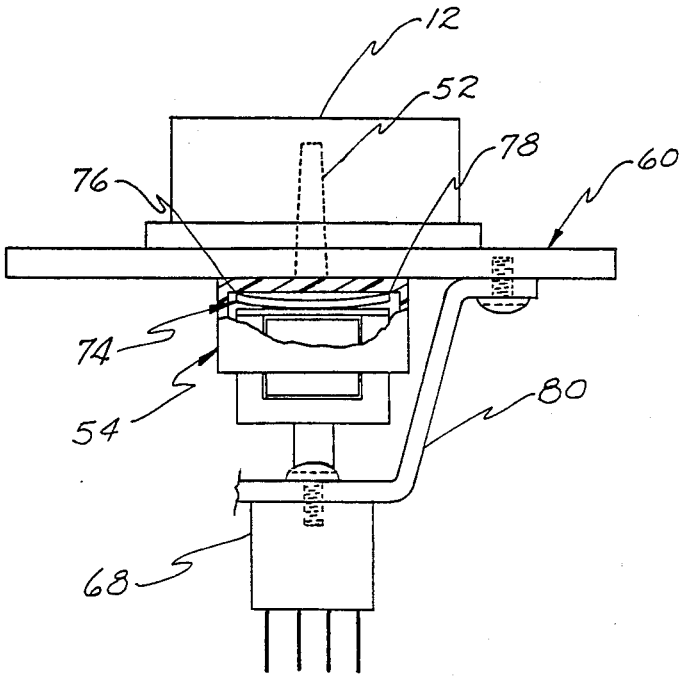
FIG. 3 is an end view in partial cutaway of the control of FIG. 2.

FIG. 3 shows the bowed sheet that constitutes a preferred embodiment of spring 74. The sheet exerts a force against cap 54 along parallel lines through points 76 and 78.Sheet 74 may comprise any suitable resilient material, such as various metals and alloys well known in the art. Stainless steel is a preferred material.

There is an interplay between the spring force that urges top section 56 against surface 58 and the spring forces that restore push buttons 34 and 36 to the rest positions shown in FIG. 2. Specifically, the restoring force exerted on a push button must be great enough to overcome the frictional force between surfaces 56 and 58. Otherwise, the push button would not return to its rest position when the force moving the slider is released.

Housing 68, containing stationary conductor 70, is supported on mounting plate 60 by conventional means, such as mounting arm 80.

This device has been described, and depicted in FIG. 2, as including switch 10 as a normally-open momentary switch. Clearly, however, push buttons 34 and 36 could alternatively operate so that depressing either button serves to open a normally-closed switch.

The sliding electrical control of this invention is preferably an element of a system for controlling a-c power to a load of one or more lamps, motors, or such, from at least two locations. Each location has the control depicted in FIG. 2. By moving the slider at a location, the slider at that location "takes-command;" i.e., it controls the device that regulates the power to the load. The circuitry that accomplishes the take-command function has been described in application Ser. No. 857,739, filed Apr. 29, 1986, (now U.S. Pat. No. 4,689,547) which is incorporated herein be reference. Preferably, the control of this invention is an element of a lighting control system. Lighting control systems suitable for use with the control of this invention include phase control dimming systems, such as those that appear in FIG. 3 of application Ser. No. 857,739 (now U.S. Pat. No. 4,689,547).

The present invention having been described in connection with preferred embodiments, many variations and modifications will now become apparent to those skilled in the art. Therefore, the present invention is to be limited not by the specific disclosure, but only by the appended claims.

We claim:

1. A sliding electrical control comprising, in combination:

(a) a mounting plate having a first and second surface and an elongated slot through it;

(b) a stationary electrical conductor spaced apart from and supported by the mounting plate first surface;

(c) a slidable electrical conductor mounted for sliding parallel to the elongated slot, while maintaining electrical contact with the stationary electrical conductor;

(d) a switch between the mounting plate first surface and the slidable electrical conductor, coupled to the slidable electrical conductor and having two opposite ends that secure switch actuators facing in opposite directions, parallel to the elongated slot;

(e) a cap comprising (i) a top section, between the mounting plate first surface and the switch, for sliding along the mounting plate first surface and (ii) an end section adjoining each of the actuators for transmitting forces to operate the actuators and to slide the switch; and (f) coupling means for transmitting a force through the slot to the cap.

2. The control of claim 1, further comprising bias means adjacent to and between the switch and the cap top section for providing a bias force to urge the cap top section against the mounting plate first surface.

3. The control of claim 1 in which the stationary and slidable electrical conductors are elements of a potentiometer.

4. The control of claim 2 in which the bias force is provided along at least two non-collinear lines.

5. The control of claim 2 in which the bias means comprises a spring.

6. The control of claim 5 in which the bias means comprises a spring formed of a bowed sheet of resilient material.

7. The control of claim 6 in which the resilient material is stainless steel.

8. The control of claim 1, further comprising a slider, connected to the coupling means, for sliding adjacent to the mounting plate second surface and providing forces to the cap.

* * * * *